US005970536A

United States Patent [19]

Suarez

[11] Patent Number: 5,970,536

[45] Date of Patent: Oct. 26, 1999

[54] CAMP SHOWER APPARATUS

[76] Inventor: Silvio Suarez, 13810 Ramona Dr., #A, Whittier, Calif. 90605

[21] Appl. No.: 09/119,548

[22] Filed: Jul. 20, 1998

[51] Int. Cl.[6] ..... A47K 3/22

[52] U.S. Cl. ..... 4/599; 4/600; 4/602

[58] Field of Search ..... 4/599, 600, 602, 4/612, 596, 597, 900; 135/91, 115, 117

[56] References Cited

U.S. PATENT DOCUMENTS

| | | | |
|---|---|---|---|
| D. 321,292 | 11/1991 | Gabriel . | |
| 1,409,609 | 3/1922 | Stockle | 135/91 |
| 3,293,664 | 12/1966 | Coons | 4/599 |
| 4,223,690 | 9/1980 | Wera et al. . | |
| 4,539,720 | 9/1985 | Westerweller . | |
| 4,866,794 | 9/1989 | Davis . | |
| 4,975,992 | 12/1990 | Patterson et al. | 4/599 |
| 5,311,620 | 5/1994 | Ratje . | |
| 5,446,930 | 9/1995 | Clark . | |
| 5,790,992 | 8/1998 | Ray | 4/599 |

*Primary Examiner*—David J. Walczak
*Attorney, Agent, or Firm*—Gene Scott-Patent Law & Venture Group

[57] ABSTRACT

A camp shower apparatus provides four segmented corner support rods mounted in a convergent manner between a base platform and a top platform. A fabric side wall enclosure may be draped around the support rods or may be placed inside of the support rods. Fastener eyes are arranged so as to maintain the fabric side wall in position and a front flap holds a zipper or other fastener for closure of the side wall. A shower water bag may be hung from the tip platform for washing oneself or a toilet may be placed within the enclosure for sanitary use.

7 Claims, 2 Drawing Sheets

CAMP SHOWER APPARATUS

BACKGROUND OF THE INVENTION

1. Field of the Invention

This invention relates generally to portable enclosures for use in a campground or other out-of-doors applications, and more particularly to a portable shower or toilet enclosure for use in a campground.

2. Description of Related Art

The following art defines the present state of this field:

Davies, U.S. Pat. No. 4,866,794 describes a portable shower is constructed from a collapsible flexible material and is designed to be suspended from an overhead support when being utilized. The shower carrying case also functions as a water delivery container during periods of use.

Were et al, U.S. Pat. No. 4,223,690 describes a portable enclosure which may be erected upon uneven terrain in the outdoors where curtained compartments may be utilized as shower and dressing areas in recreational and camping environments.

Gabriel, U.S. Des Pat. No. 321,292 describes a front elevation view of a portable dressing room showing new design.

Clark, U.S. Pat. No. 5,446,930 describes a portable shower is formed of a base and upper shower ring carrying spray nozzles. The base and the ring each have sockets directed slightly outwardly from the vertical. Straight plastic pipes are fitted into the sockets to join the base and the shower ring, and, since the pipes have to be flexed in order to fit within the sockets, the pipes provide a tensioned fit which holds the unit together. At least one of the pipes carries a water inlet so that it can be connected to a hose and, so, carry water to the ring. Two hoses can be used, if desired one for hot water and the other for cold; and then two of the pipes will carry water to the ring. In such event, a mixing chamber is provided in the ring so water of uniform temperature comes from each of the spray outlets in the shower ring. The base is a tank which holds water to provide weight and, so stability to the shower.

Ratje, U.S. Pat. No. 5,311,620 describes an improved portable shower having a one piece inflatable enclosure anchored to the ground by filling the bottom ring with water or alternately using provided flaps with eyelets to stake it to the ground. A common water sprayer having a modified air pump that can be used to inflate the enclosure, a positionable spray nozzle to direct water stream more effectively, and an extended hose for overhead reach when water container is upright on the ground.

Westerweller, U.S. Pat. No. 4,539,720 describes a lightweight portable shower foldable into a backpack for campers or the like. A pliable water storage bag lies on a floor unit that also supports a vertical sectioned standpipe having a valved showerhead at the top. An annular curtain rod is held in a horizontal position by a hooking device at the top of the standpipe and supports a tubular shower curtain that is elastically connected to a rigid footpad atop the storage bag. In use, the weight of the user standing on the footpad provides water pressure to force water through the standpipe and showerhead. The elastic coupling to the footpad assures that the curtain will remain taut as water is forced from the storage bag.

The prior art teaches the construction details and uses of a variety of camp shower or other use portable enclosures. However, the prior art does not teach such a camp shower type portable enclosure having the simple construction, easy of assembly/disassembly and other advantages enjoyed by the present invention. The present invention fulfills these needs and provides further related advantages as described in the following summary.

SUMMARY OF THE INVENTION

The present invention teaches certain benefits in construction and use which give rise to the objectives described below.

The present invention provides a camp shower apparatus providing four segmented support rods, a base platform and a top platform which may be assembled in seconds. A fabric side wall enclosure may be draped around the support rods or may be placed inside of the support rods.

A primary objective of the present invention is to provide a camp shower enclosure having advantages not taught by the prior art.

Another objective is provide such an enclosure that is easily and quickly assembled and disassembled.

A further objective is to provide such an enclosure that provides a truncated pyramidal shape for improved rigidity and strength.

A further objective is to provide such an enclosure that provides accessories having a C-clamp type snap-on feature for quick attachment and positioning to the support rods as desired and expedient.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
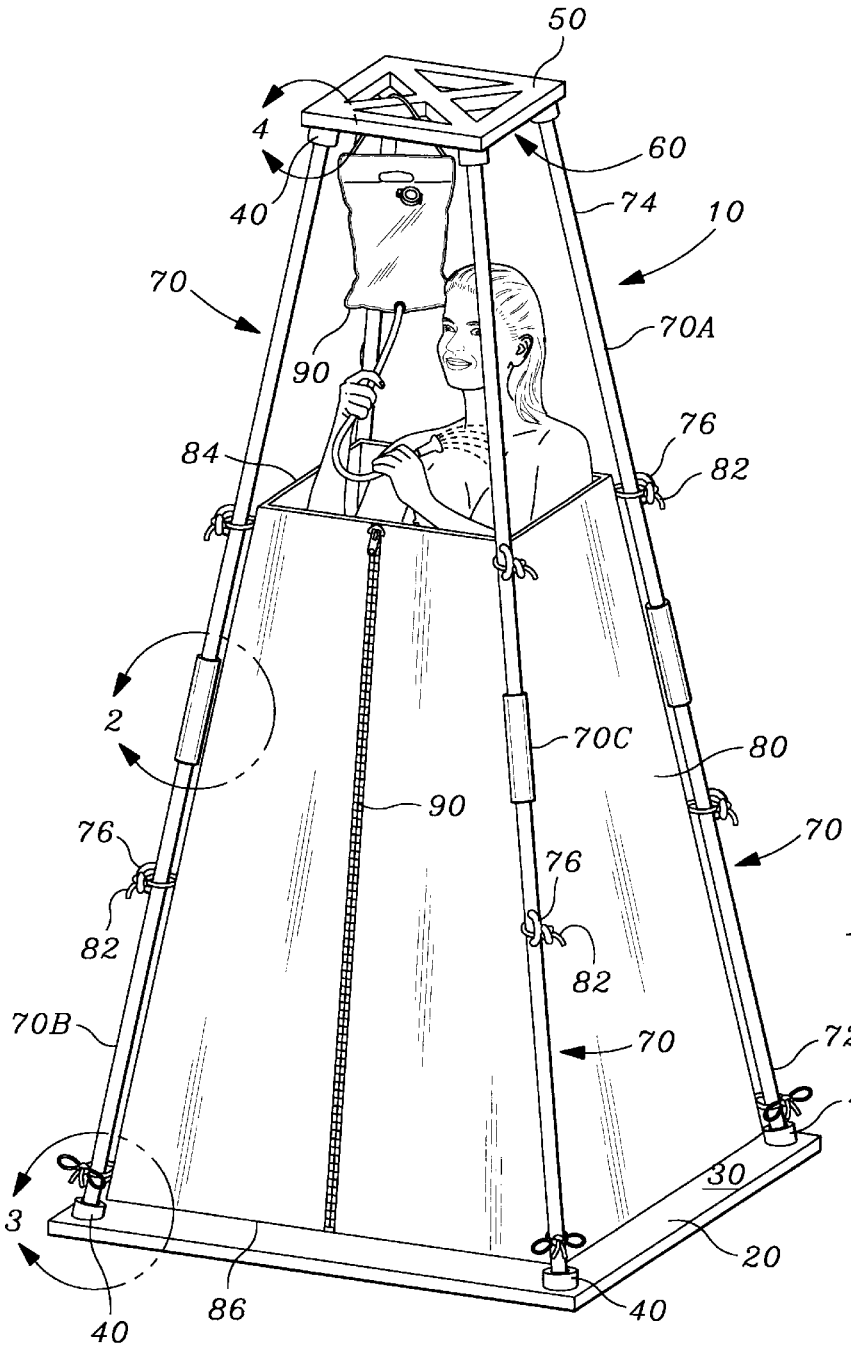
FIG. 1 is a perspective view of the preferred embodiment of the present invention.

The above described drawing figures illustrate the invention, a portable shower enclosure apparatus 10 comprising a base platform 20, made of wood, metal or plastic as a rigid structure for supporting the weight of an adult individual. Base platform 20 is designed for being supported by a ground surface such as any grass or dirt surface in a campground. The base platform 20 provides an upwardly facing surface 30 having a plurality of rod couplings 40 fixed thereon in opposing corners thereof, the rod couplings 40 are cup shaped and holes therein are angled for receiving support rods as is described below. A top platform 50 is positioned above the base platform 20 and is preferably centered over it. The top platform 50 provides a downwardly facing surface 60 having a plurality of the rod couplings 40 fixed thereon. A plurality of support rods 70 are provided as shown in FIG. 1, each of the support rods being engaged at a lower end 72 by one of the plurality of rod couplings 40 of the base platform 20, and at an upper end 74 by a corresponding one of the plurality of rod couplings 40 of the top platform 50, in such manner as to rigidly position the top platform 50 above the base platform 20 with such a spacing therebetween as to enable an adult to stand upright between the base platform 20 and the top platform 50, the support rods 70 and the rod couplings 40 being positioned such that the support rods 70 converge toward the top platform 50. The corresponding engagement holes 40A in the rod couplings 40 of the base platform 20 and of the top platform 50 are angled so as to receive the support rods 70 in said convergent orientation. Circles 2,3 and 4 in FIG. 1 define portions of the invention depicted in FIGS. 2,3 and 4 respectively.

A side fabric wall 80 is engaged with, and removably fixed to the support rods 70 so as to form a truncated pyramid shape extending from the base platform 20 upwardly, the side fabric wall 80 providing a closure means 90, such as a zipper or hook and loop type fastener, so as to fully enclose the side fabric wall 80. In FIG. 1 the side fabric wall 80 is shown positioned within the support rods 70, but it could, just as easily be positioned on the outside of the support rods 70 and such would be preferably if the apparatus were used for enclosing a toilet (not shown), for example.

Figure 2:
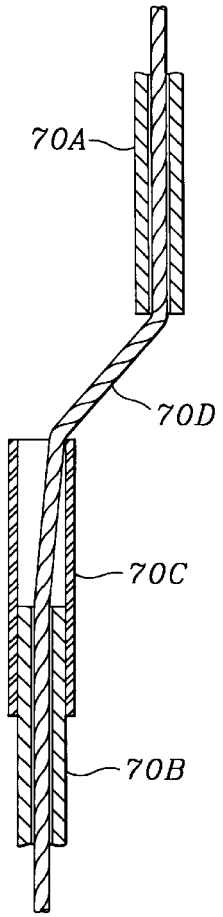
FIG. 2 is a sectional view thereof in the area depicted by circle 2 in FIG. 1 showing a preferred construction of the segmented support rods as they might appear when erecting or breaking down the supporting poles of the invention.
Figure 4:
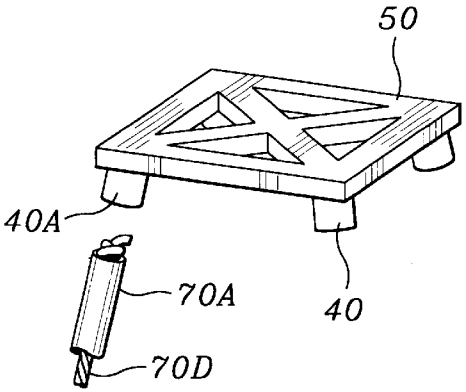
FIG. 4 is a partial view of the coupling arrangement between the support rods and the top platform thereof.
Figure 3:
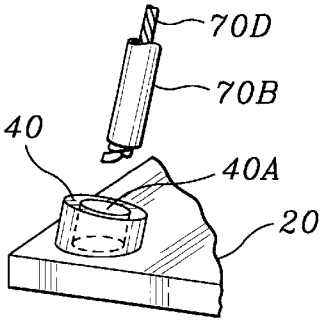
FIG. 3 is a partial view of the coupling arrangement between the support rods and the base platform thereof.

Preferably, each of the support rods 70 comprises at least two separable portions 70A and 70B made of a rigid tubular extruded shape and joined with a rod engaging means 70C also a tubular shape, but of a larger size such that the support rod separable portions 70A and 70B are able to slide therein with a tight fit. The support rods are further improved by including an elastic cord 70D within as shown in FIG. 2. Such a cord 70D is knotted at its upper and lower ends, as shown in FIGS. 4 and 3 respectively. Cord 70D insures that the support rods, when assembled linearly, as shown in FIG. 1, will not inadvertently come apart causing the apparatus to become weakened. However, such elastic cords 70D allow the support rods 70 to be quickly and easily disassembled, see FIG. 2, and compactly packed for portage. Further, preferably, each of the support rods 70 provides one or more eye fixtures 76 for attaching a tie cords 82 of the side fabric wall 80, certain of the eye fixtures 76 being positioned so as to be adjacent to an upper fabric edge 84 of the side fabric wall 80 when a lower fabric edge 86 of the side fabric wall 80 is adjacent to the base platform 20. Therefore, the side fabric wall is held securely in place along its lower fabric edge 86 and is stretched upwardly as well to be held securely along its upper fabric edge 84 in order to cover the side view of a person standing therein up to the person's shoulders in order to provide privacy to the person. The fact that the support rods 70 are convergent toward the top platform 50 is an important aspect of the invention especially when the side fabric wall 80 is draped on the outside of the support rods 70 since, in this configuration, the fabric wall 80 is better supported and held in place.

Figure 5:
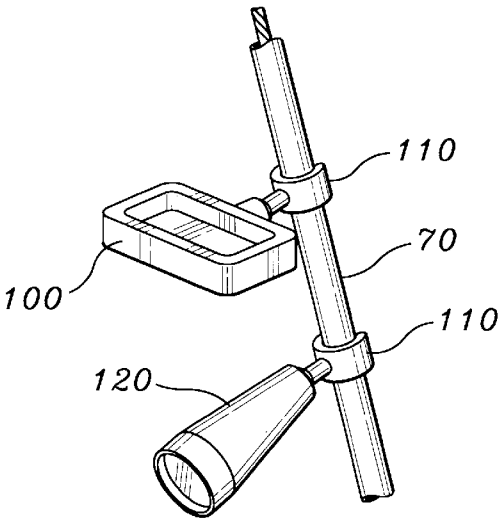
FIG. 5 is a partial view showing the manner in which a soap dish and lamp of the invention are attached to a support rod of the invention.

Preferably, a water container 90 is suspended from the top platform 50 for providing water for personal hygiene activities, such as a washing and rinsing, within the apparatus 10. To further facilitate such activities, the apparatus 10 preferably includes a soap dish 100 (FIG. 5) having a C-clamp 110 of such diameter as to be snap-attached onto one of the support rods 70 so as to position the soap dish 100 for personal hygiene activities within the apparatus. To even further facilitate such activities, the apparatus may further include a lamp 120 having the C-clamp 110 of such diameter as to be snap-attached onto one of the support rods 70 so as to position the lamp for illuminating personal hygiene activities within the apparatus 10 especially at night.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A portable shower enclosure apparatus comprising:

a base platform for being supported by a ground surface, the base platform providing an upwardly facing surface having a plurality of cup-shaped rod couplings fixed thereon in opposing corners thereof;

a top platform for being positioned above the base platform, the top platform providing a downwardly facing surface having a plurality of cup-shaped rod couplings fixed thereon;

a plurality of support rods, each of the support rods being engaged at a lower end by one of the plurality of cup-shaped rod couplings of the base platform, and at an upper end by a corresponding one of the plurality of cup-shaped rod couplings of the top platform, in such manner as to capture the support rods to rigidly position the top platform above the base platform with such a spacing therebetween as to enable an adult to stand upright between the base platform and the top platform, the cup-shaped rod couplings being angled so that the support rods converge toward the top platform forming a convergent orientation of the support rods;

a side fabric wall engaged with, and removably fixed to the support rods so as to form a truncated pyramid extending from the base platform upwardly, the side fabric wall providing a closure means so as to fully enclose the side wall fabric wall.

2. The apparatus of claim 1 wherein each of the support rods provides an integral eye fixture engaged with a tie cord of the side fabric wall, the eye fixture being positioned so as to be adjacent to an upper fabric edge of the side fabric wall when a lower fabric edge of the side fabric wall is adjacent to the base platform.

3. The apparatus of claim 1 wherein each of the support rods provides an eye fixture for attaching a tie cord of the side fabric wall, the eye fixture being positioned so as to be adjacent to an upper fabric edge of the of the side fabric wall when a lower fabric edge of the side fabric wall is adjacent to the base platform.

4. The apparatus of claim 1 further including a water container, the water container being suspended from the top platform for providing water for personal hygiene activities within the apparatus.

5. The apparatus of claim 1 further including a soap dish having a C-clamp of such diameter as to be snap-attached onto one of the support rods so as to position the soap dish for personal hygiene activities within the apparatus.

6. The apparatus of claim 1 further including a lamp having a C-clamp of such diameter as to be snap-attached onto one of the support rods so as to position the lamp for illuminating personal hygiene activities within the apparatus.

7. The apparatus of claim 1 wherein corresponding engagement holes in the rod couplings of the base platform and of the top platform are angled so as to receive the support rods in said convergent orientation.

* * * * *